US005704991A

United States Patent [19]

Marcus

[11] Patent Number: 5,704,991

[45] Date of Patent: Jan. 6, 1998

[54] WASHING METHOD AND COMPOSITION

[75] Inventor: Thor Marcus, Oslo, Norway

[73] Assignee: Ing. Thor Marcus Kjemiske AS, Oslo, Norway

[21] Appl. No.: 513,890

[22] PCT Filed: Feb. 24, 1994

[86] PCT No.: PCT/NO94/00046

§ 371 Date: Nov. 13, 1995

§ 102(e) Date: Nov. 13, 1995

[87] PCT Pub. No.: WO94/19441

PCT Pub. Date: Sep. 1, 1994

[30] Foreign Application Priority Data

Feb. 24, 1993 [NO] Norway ..... 930650
Sep. 22, 1993 [NO] Norway ..... 933375

[51] Int. Cl.[6] ..... B08B 3/00; B08B 3/04; B08B 3/08

[52] U.S. Cl. ..... 134/26; 134/29; 134/34

[58] Field of Search ..... 134/26, 29, 34, 134/38, 40, 4, 42, 32, 36; 510/427, 435, 207, 365

[56] References Cited

U.S. PATENT DOCUMENTS

| | | | |
|---|---|---|---|
| H468 | 5/1988 | Malik et al. | 510/435 |
| 4,289,640 | 9/1981 | Falivene | 510/365 |
| 4,502,891 | 3/1985 | Brocklehurst et al. | 134/4 |
| 4,643,840 | 2/1987 | Brocklehurst et al. | 510/207 |
| 4,772,415 | 9/1988 | Adone | 510/188 |
| 4,847,004 | 7/1989 | McLeod | 510/427 |

FOREIGN PATENT DOCUMENTS

| | | |
|---|---|---|
| 376 928 | 6/1975 | Sweden . |
| 408 715 | 7/1979 | Sweden . |
| 2027736 | 2/1980 | United Kingdom . |

OTHER PUBLICATIONS

McCutcheon's Functional Materials, 1992 vol. 2 pp. 262–280, Mc Cutcheon Division, McPublishing Co.

Hawley's Condensed Chemical Dictionary, 1993 Van Nostrand Reinhold Company.

Ernest W. Flilck, Advanced Cleaning Product Formulations, 1989, pp. 240 and 314.

*Primary Examiner*—Robert J. Warden
*Assistant Examiner*—Alexander Markoff
*Attorney, Agent, or Firm*—Jenkens & Gilchrist, P.C.

[57] ABSTRACT

It is disclosed a process for cleaning vehicles, especially cars, with an alkaline washing composition, preferably comprising one or more surfactants, where the washing composition is sprayed onto the vehicle with one or more nozzles or foam generators and where the alkaline washing composition in connection with the spraying onto the vehicle is combined with an aqueous solution of a cellulose derivative forming a semi-stable composition with congeals and absorbs/adsorbs the dirt particles removing them from the surface when the composition is rinsed off. It is preferred to add fibers in the rinsing water when hosing the composition off or in the cleaning solutions, and it is also preferred to perform the process at a pressure, e.g. 1–150 bars. The two components forming the cleaning composition are preferably combined by using an ejector system operated with water for obtaining the relevant concentrations of each component. The fiber dispersion may also be used separately with conventional washing compositions.

17 Claims, 2 Drawing Sheets

WASHING METHOD AND COMPOSITION

BACKGROUND

The present invention presents an improved system and composition for washing dirty surfaces, and which is especially developed for washing vehicles.

It is previously known numerous types of washing compositions to be used when washing e.g. vehicles, but all of these compositions are meant to be used together with either manual washing or with rotating brushes or hanging cloth which mechanically remove dust and dirt from the surface. Such manual or mechanical washing is, however, abrasive on the surface and may in many cases destroy the finish or the paint on the vehicle. Previously it has also been attempted to hose off the layer of dust from the surfaces of the vehicle, but it has been found that the layer of dust adheres so strongly that spraying or hosing even at high pressure has not been satisfactory even with the addition of known washing solutions.

The need to clean vehicles without any mechanical treatment has increased, and has been the basis for attempts to find solutions to this problem the last 10 years by using different kinds of compositions and systems. The common factor for all these compositions is that the surface does not become fully clean on account of a fine layer which will often remain and which is not being removed by high pressure spraying in combination with a cleaning composition without using strong compositions which will have negative effects on the surf ace of the vehicle, and will also represent a negative effect on the environment and corrode the car.

Many manufacturers have attempted to use acids and/or alkaline solutions and also combinations thereof, but the side effects with corrosion both on the car itself and also on sewer systems etc.

SUMMARY

According to the present invention it has surprisingly been found that a composition comprising a mixture of a water-soluble cellulose derivative, such as a hydroxyl cellulose derivative, e.g. ethyl hydroxy cellulose, in a neutral to alkaline aqueous dispersion mixed with an alkaline detergent, will form, an agglomerate when it is added to the surface which is to be rinsed, and which partially adsorbs and partially absorbs the dirt particles so that they no longer adhere to the surface and easily may be hosed off together with the agglomerate. This saves to a large degree the surface and represents a significant improvement of the cleaning result compared with the previously known washing compositions.

The new effect of the present washing solution and system is that it is made more viscous in the foaming process and that it is preferably supplied with non-abrasive fiber particles in the rinsing/hosing process substituting the mechanical work being necessary in the previous car-washing systems as mentioned supra.

The surprising effect of the cleaning solution and process according to the present invention is that each of the cellulose derivative solution and the alkaline solution are readily water-soluble, but corresponding concentrations of stem solutions mixed directly with each other are not soluble. Thus a one-component system with these two stem solutions is not possible, and the two stem solutions enter a temporary semi-stable condition when mixed with water in a container/feeding tank immediately prior to its introduction into the foam generator, from which the combined foam may be sprayed onto the surface which is to be cleaned, and whereupon the composition is congealing absorbing and adsorbing all the dirt particles onto which it is applied. On account of the limited stability of the washing composition according to the invention, only a quantity large enough to clean one or a small number of vehicles or cars is made continuously as needed, and the foaming process increases the volume of the solution to such a degree that the pre-made quantity is enough to clean the vehicle. In this connection a quantity of 2–10 1 premade non-foamed cleaning solution according to the invention will cover an ordinary vehicle/car when expanded as a foam, and the volume of such a foam may be increased 3–8 times. Alter a dwell time of 30–60 sec. the dirt is then absorbed/adsorbed into the solution.

When hosing off the cleaning solution and dirt from the surface of the vehicle, it is preferred that fibers are introduced in the rinsing water (see infra), and it is also preferred that this is done at a pressure ranging from 1 to 150 bar.

The aqueous dispersion of the hydroxy cellulose derivative added a neutral to alkaline solution of a conventional washing composition gives better washing properties. When using conventional washing compositions together with the cellulose derivative according to the present invention, it has been found that there is achieved a synergistic effect when mixing the cellulose derivative and the alkaline washing composition according to the invention, which increases the cleaning effect of the end product significantly compared to each of the components used alone. Furthermore it has been found that combining the cellulose derivative with the conventional alkaline solution at concentrations which should make them mutually un-mixable, and introducing such a composition through a foam generator, preferably at high pressure, to the surface which is to be cleaned, there is produced a semi-stable composition which after a time congeals to a gel-like substance which removes the dust and dirt and leaves the surf ace clean without any form of abrasive treatment.

BRIEF DESCRIPTION OF THE DRAWINGS

Below the invention will be more closely disclosed with reference to embodiment examples and also with reference to the figures where.

DETAILED DESCRIPTION

Figure 1:
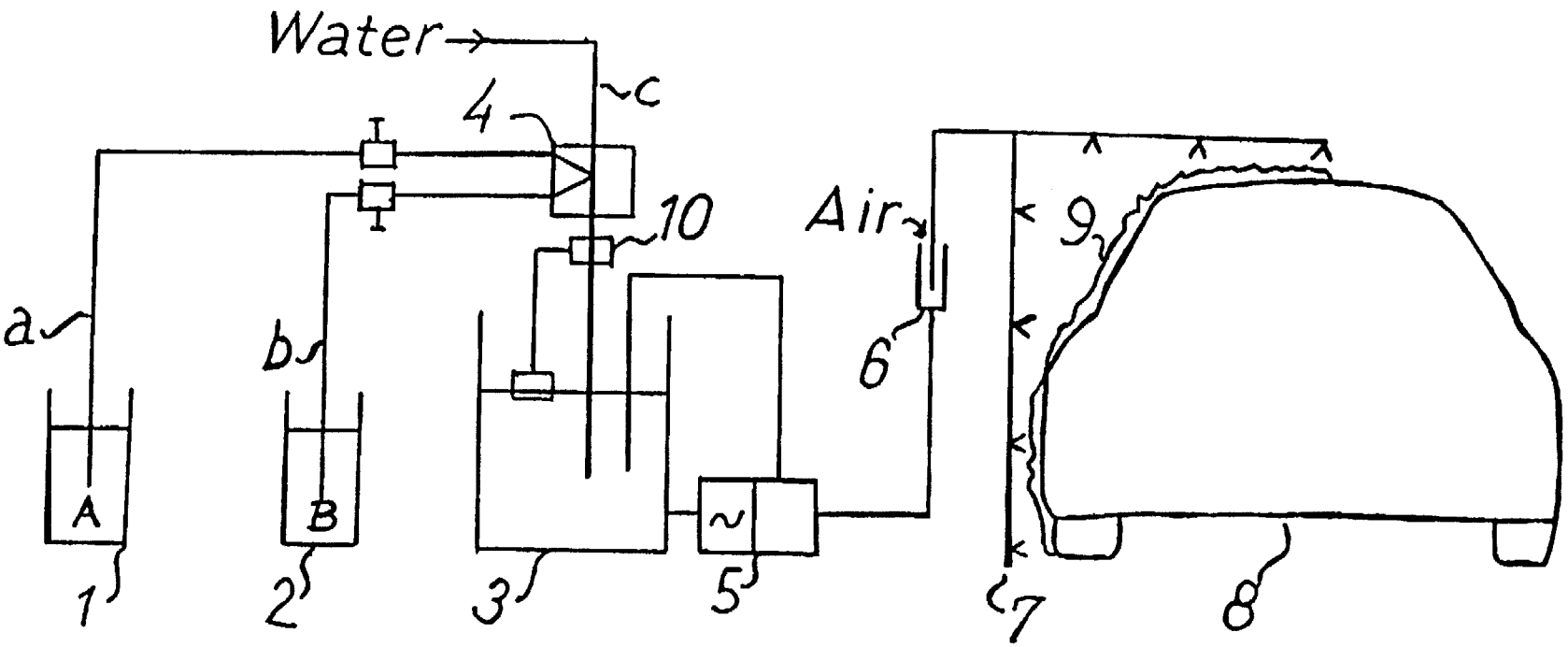
FIG. 1 shows one embodiment of the system and process according to the invention.

In those cases where there is referred to percentages in the disclosure, unless otherwise specified, this refers to percentages per volume.

To produce a washing composition according to the present invention there may e.g. initially be made two stem solutions comprising the cellulose derivative in the first solution (solution B) which is basic (pH 7–14, preferably 9) and may contain a small amount of the washing solution (1–5%). The concentration of the cellulose derivative in the aqueous dispersion B lies preferably within the interval 0–10%, more preferred 0–5%, e.g. 2% by weight. As an example of the cellulose derivative there may be mentioned "Bermocoll E (230–481)", which represents different degrees of ethyl-hydroxyethyl cellulose, but also other types of cellulose derivatives will be obvious to the person skilled in the art after having read the present disclosure.

Solution A is added to solution/dispersion B as an alkaline aqueous solution with a pH within the interval 7–14, e.g. 9. This solution may be merely an aqueous alkaline solution with a pH within the above indicated interval, but it is preferred to use a neutral to alkaline washing solution on account of the above mentioned preferred content of surfactants. The use of a suitable washing composition will be obvious to a person skilled in the art since this may only be of a type being conventionally suited for the relevant type of washing. As an example it may be mentioned that for the washing of vehicles there may be used a stem solution such as "Forvask Vinter" (a liquid alkaline washing and cleaning composition containing White Spirit, complexing agents, surfactants, derivatives of glycol and water), "Micro" (a liquid tixotropic, alkaline washing and cleaning agent containing High Flash White Spirit, ethylenediamine tetraacetic acid natrium salt, surfactants and water), "Maskin Shampoo" (a liquid alkaline washing composition containing surfactants, ethyldiglycol, complexing agents, silicates and water), "Super Cleaner" (a liquid alkaline washing composition containing surfactants, complexing agents, silicates and water), all being obtainable from Thor Marcus Kjemiske A/S. These washing compositions are of a liquid type, but also solid water-soluble washing agents may of course also be used.

The solution A and the solution B will be separately supplied as aqueous stem concentrates and are mixed in the system as mentioned supra into the preferred end solution by adding the water. Thus stem concentrate B may be present in a mixture ratio between water and the cellulose derivative within the interval 1:5 to 1:100, e.g. 1:50, most preferred 1:20.

Stem concentrate A may be adjusted according to the circumstances based on the knowledge of the person skilled in the art, since the composition or the use thereof will not differ from the conventional use when adding solution B, but the effect of the combined washing composition will, on account of the above mentioned synergistic washing effect, be significantly improved. Stem concentrate A may, all the same, when using the above mentioned stem concentrate "Forvask Vinter" I have a mixture ratio between the stem concentrate and water of 1:10–1:100, e.g. 1:50, but may in extreme cases also be used undiluted.

By using this two-component system no mechanical touch is needed before rinsing/hosing as described.

As an example stem concentrate B (2) (20% aqueous solution) and stem concentrate A (1) (50% aqueous solution, pH=9,0) are made separately. These two concentrates are ejected through individual pipes/hoses/lines (a,b) in quantities of 750 ml/min for concentrate A and 250 ml/min for concentrate B, respectively, and are combined by joining the pipes/hoses/lines into a common line (4), preferably by using a water-based ejector system wherein the individual pipes (a,b) are combined upstream of a narrowing of a water-leading ejector pipe (c), and are sucked up by an ejector effect into the water-leading pipe into the feeding tank (5). The quantity of water flowing in the water-leading pipe (c) may in this example be 5.7 l/min. It will be possible to regulate the mixing conditions being specified supra by using adjustable nozzles/valves on each separate pipe, and the mixing may be stopped by using a stop valve 10 on the ejector pipe (c). From here it is possible to spray the combined solutions directly onto the surface which is to be cleaned, but it is preferred to let the combined solution made ready for use, pass to a feeding tank (3). The feeding tank (3) holds just enough solution for a few washing operations. From the feeding tank (3) the solution made ready for use may be sucked via a pump (5), preferably at high pressure, to an air-adding foam-forming apparatus (6) such as a foam generator, and is sprayed onto the vehicle or the surface (8) which is to be cleaned. The solution according to the invention will thereby form a layer of foam (9) on the vehicle, which after a short while (0.5–5 min) will agglomerate, surround, incorporate and "lift" the dust and dirt particles on the surf ace up and into the foam. Additionally the cellulose derivative in this system will run together to form a gel-like substance which, when hosed off, will draw and pull and remove dust and dirt particles from the surface which is to be cleaned.

Figure 2:
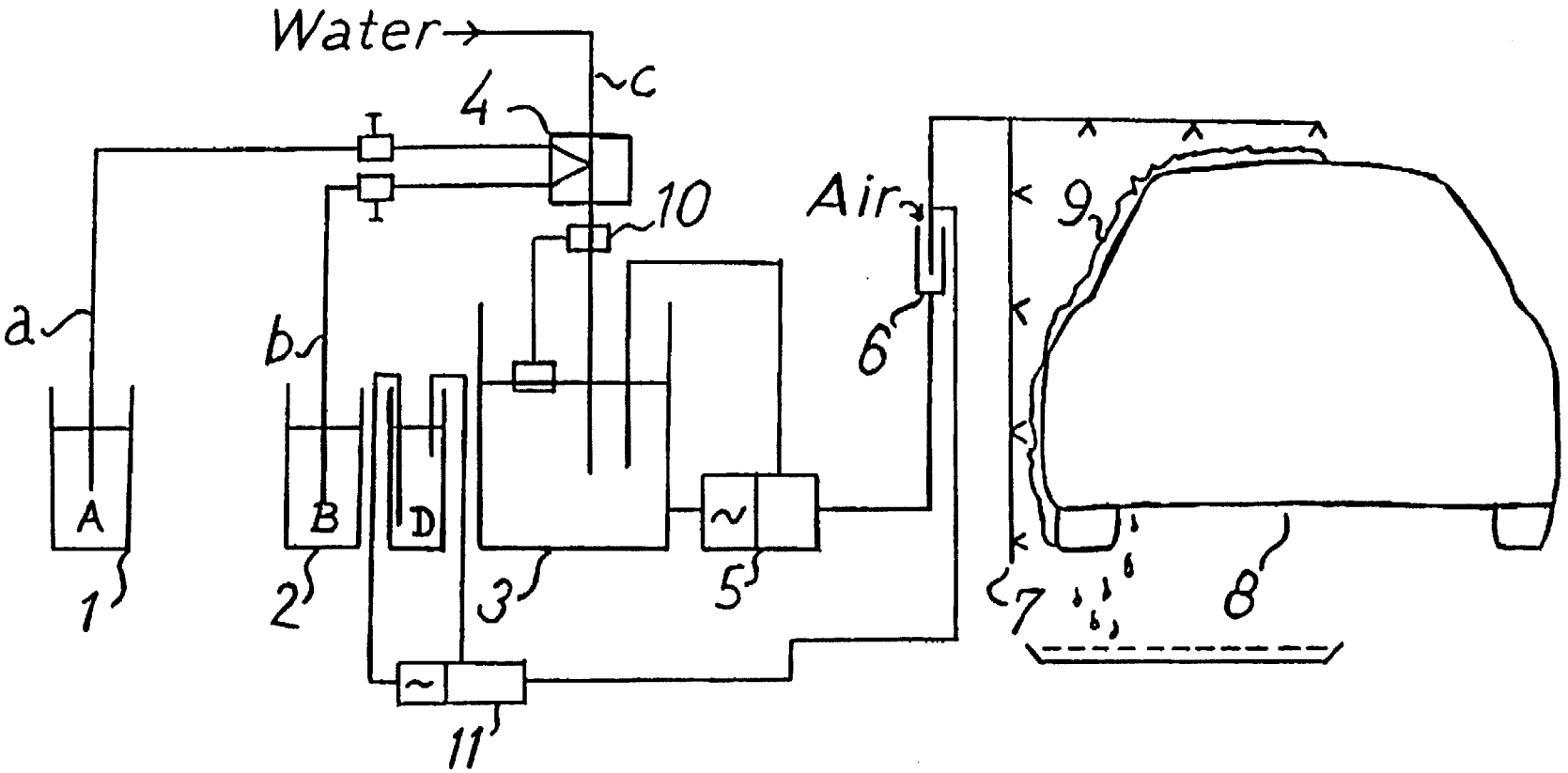
FIG. 2 shows another and further developed embodiment of the system and process according to the invention.

When considering very dirty conditions, the solution may be made further effective by incorporating or using a small mount of non-abrasive fiber particles. The fiber material may be dispersed in the water (D, see FIG. 2) or e.g. in the cellulose derivative and/or the alkaline washing solution mentioned supra in a container and be pumped into the foam mixture or the foam-forming preparation 6 by a pump 11 being operated when needed or directly into the rinse-water. By-pass from the pump or a mixing device keeps the mixture in dispersion. The added fiber material will adsorb the minuscule particles having a strong affinity to the surface, and lead these into the gel-like mass from the foam. Then the surf ace may be easily hosed clean, preferably by using a water jet mixed with fibers at high pressure. The solution in the container D may in many cases substitute for the injection from container B.

An alternative, and preferred way to use the fiber dispersion is, however, to spray a dispersion of the fibers separately onto the surface which is to be cleaned, after adding the foam. The foam composition according to the present invention should be allowed a dwell time on the surface, e.g. 0.5–5 min, before rinsing with water in which fiber preferably is injected, and this procedure will further enhance the cleaning effect of the foam cleaning solution. The fibers are non-abrasive and will have the effect of a soft paper tissue optionally the fiber solution/dispersion may be made by using a detergent in the dispersing liquid for further enhancing the cleaning effect.

For the improved washing system and procedure according to the present invention, there may be used ground or unground fibers, and such fibers may e.g. be obtained by conventional fiber processes producing an optimal freeness. Thus the pulp material being used may e.g. be sulphite pulp, sulphate pulp, thermomechanical pulp, ground wood, semi-chemical pulp, etc. Examples &such pulp material which may be used in the present invention may be leaf wood sulphate pulp (e.g. "Tofte EUC (ECF)") or needle wood sulphate pulp (e.g. "Tofte 90 (ECF)"). An exemplary and preferred pulp type may be "Folla CTMP 100/60" mechanical wood pulp, but corresponding wood pulp types may also be used, as mentioned supra.

The length of the fiber particles may be varied within wide limits. They may have a conventional fiber length and may e.g. lie within the interval 0.5 mm–5.0 mm. Very minor amounts &added fiber material in the rinsing composition according to the present invention is necessary to achieve the wanted effect, but the volume of added fiber is not critical, so that larger quantities may also be tolerated and even preferred. The concentration of the fibers in the fiber stem solution may be e.g. 0–40 g/l, preferably 5 g/l, although this is not critical. The weight of fiber may e.g. be 10 g fiber in a liquid volume of about 2–10 1, also being a volume which may be used for washing a conventional private car. It may also be used larger amounts of fibers than the one specified supra, an then the effect is somewhat improved, but the quantity of fiber added in the process must not be so large that it causes blockage of pumps and nozzles. If the nozzles leading the washing solution according to the invention are flushed shortly after the fiber solution/dispersion has passed, it will be avoided that the system is blocked.

The fiber particles may easily be filtered in the sewer system together with the adsorbed dirt and thus contribute to a cleaner waste water. The system will in an oil separator function as an oil adsorbing agent, and this will facilitate recirculation of the water.

The total effect of the above indicated sequence of events is that when the foam being produced according to the invention is rinsed off from the surface after a dwell time, the surface will be free from dust and dirt particles without the need for mechanical touch of the surface.

The aqueous fiber-containing rinsing stem-solution (D) is produced by dispersing/mixing the fiber material with water together with surfactants to facilitate the dispersion process of the fibers.

The fiber material may also be used separately or in combination with conventional washing solutions for obtaining an improved washing result.

I claim:

1. A process for washing a surface of a vehicle comprising:

providing an alkaline solution of a washing composition having a pH in the range from about 7 to about 14;

providing an aqueous solution of a cellulose derivative;

adding a fiber material to at least one of said alkaline solution of said washing composition or said aqueous solution of said cellulose derivative;

combining said alkaline solution of said washing composition with said aqueous solution of said cellulose derivative, at least one of which contains the fiber material, to form a combined solution containing said fiber material; and spraying said combined solution containing said fiber material onto the surface of the vehicle.

2. A process for washing a surface of a vehicle comprising:

providing an alkaline solution of an alkaline washing composition having a pH in the range from about 7 to about 14;

providing an aqueous solution of a cellulose derivative;

combining said alkaline solution of said washing composition with said aqueous solution of said cellulose derivative to form a combined solution;

adding a fiber material to said combined solution; and spraying said combined solution containing said fiber material onto the surface of the vehicle.

3. A process for washing a surface of a vehicle comprising:

disposing a fiber material onto the surface of the vehicle;

providing an alkaline solution of a washing composition having a pH in the range from about 7 to about 14;

providing an aqueous solution of a cellulose derivative;

combining said alkaline solution of said washing composition with said aqueous solution of said cellulose derivative to form a combined solution; and spraying said combined solution onto the surface of the vehicle having the fiber material disposed thereon.

4. The process according to one of claims 1, 2, or 3, wherein said step of combining the alkaline solution of the washing composition with the aqueous solution of the cellulose derivative includes the aqueous solution of the cellulose derivative being combined with the alkaline solution of the washing composition with a concentration of the aqueous solution of the cellulose derivative being up to 5% by weight.

5. The process according to one of claims 1, 2, or 3, wherein said step of combining the alkaline solution of the washing composition with the aqueous solution of the cellulose derivative includes the aqueous solution of the cellulose derivative and the alkaline solution of the washing composition being combined in a ration of about 1:3.

6. The process according to one of claims 1, 2, or 3, wherein said step of combining the alkaline solution of the washing composition with the aqueous solution of the cellulose derivative includes the alkaline solution of the washing composition being added to the aqueous solution of the cellulose derivative by using a water injector and the alkaline solution of the washing composition being present in a mixing ratio with water of from about 1:10 to about 1:100.

7. The process according to one of claims 1, 2, or 3, wherein said step of combining the alkaline solution of the washing composition with the aqueous solution of the cellulose derivative including passing the combined solution through a foam producing generator.

8. The process according to one of claims 1 or 2, wherein said step of adding the fiber material includes the fiber material having a fiber length of from about 0.5 mm to about 5.0 mm.

9. The process according to one of claims 1 or 2, wherein said step of adding the fiber material includes adding the fiber material such that the fiber material is present within the combined solution in a final concentration of up to about 40 g/l.

10. The process according to claim 3, wherein said step of disposing the fiber material onto the surface of the vehicle includes the fiber material having a fiber length from about 0.5 mm to about 5.0 mm.

11. The process according to claim 3, wherein said step of disposing the fiber material onto the surface of the vehicle includes disposing the fiber material onto the surface of the vehicle in an aqueous solution having a dispersion of the fiber material in a concentration of up to about 40 g/l.

12. A precess for washing a surface of a vehicle comprising:

providing an alkaline solution of a washing composition having a pH in the range from about 7 to about 14;

combining said alkaline solution of said washing composition with said aqueous solution of said cellulose derivative to form a combined solution;

spraying said combined solution onto the surface of the vehicle; and rinsing the surface of the vehicle with a rinse solution containing a fiber material.

13. The process according to one of claims 1, 2, 3, or 12 wherein said step of spraying the combined solution includes spraying the combined solution at a pressure of about 1–150 bar.

14. The process according to one of claims 1, 2, 3, or 12, wherein said step of combining the alkaline solution of washing composition with the aqueous solution of the cellulose derivative includes obtaining a mixture ratio between the the aqueous solution of the cellulose derivative and the alkaline solution of the washing composition from about 1:1 to about 1:5.

15. The process according to claim 12, wherein said step of rinsing includes the rinse solution being an aqueous solution having a dispersion of the fiber material at a concentration of up to about 40 g/l.

16. The process to claim 15, wherein said step of rinsing includes the rinsing solution having at least one surfactant.

17. The process to claim 12, wherein said step of rinsing includes the fiber material of the rinse solution having a fiber length of from about 0.5 mm to about 5.0 mm.

* * * * *